US006907886B2

(12) United States Patent
Kemanjian

(10) Patent No.: US 6,907,886 B2
(45) Date of Patent: Jun. 21, 2005

(54) CIGAR TIP PLUG CUTTER

(75) Inventor: Gary K. Kemanjian, Irwindale, CA (US)

(73) Assignee: Belasco Jacobs & Townsley, LLP, Los Angeles, CA (US)

( * ) Notice: Subject to any disclaimer, the term of this patent is extended or adjusted under 35 U.S.C. 154(b) by 317 days.

(21) Appl. No.: 10/377,561

(22) Filed: Feb. 28, 2003

(65) Prior Publication Data

US 2004/0168693 A1 Sep. 2, 2004

(51) Int. Cl.[7] ..... A24F 13/24
(52) U.S. Cl. ..... 131/255; 131/253
(58) Field of Search ..... 131/253, 254, 131/255, 248, 250

(56) References Cited

U.S. PATENT DOCUMENTS 4,027,682 A * 6/1977 Halmaghi ..... 131/233
4,160,318 A * 7/1979 Morel ..... 30/113
4,711,254 A * 12/1987 Fleisher et al. ..... 131/189
5,535,763 A * 7/1996 Conte ..... 131/255
5,765,569 A * 6/1998 Kemanjian ..... 131/248
5,836,318 A * 11/1998 Adams ..... 131/253

* cited by examiner

*Primary Examiner*—Dionne A. Walls
(74) *Attorney, Agent, or Firm*—David A. Belasco; Belasco Jacobs & Townsley, LLP

(57) ABSTRACT

A cigar tip plug cutter uses a cylindrical cutting blade to cut a round plug from the sealed end of a cigar. The cylindrical blade has a beveled upper edge tapering from the outer diameter to the inner diameter to better retain the cut plug. The blade is secured upright to a support platform and a cigar plug ejector rod projects upwardly through the blade. The ejector rod is secured to a base portion, as are at least two supports that attach to the underside of a cigar tip receiving plate. The plate has a central orifice to permit passage of the blade. The receiving plate is urged away from the support platform by compression springs that also cause the ejector rod to project into the blade. A platform cover fits slidably over the receiving plate and includes spring-loaded balls that maintain the receiving plate in upper and lower positions.

15 Claims, 4 Drawing Sheets

CIGAR TIP PLUG CUTTER

FIELD OF INVENTION

The invention pertains to cigar smoking accessories. More particularly, the invention relates to compact cigar tip cutting devices designed to provide an easy draw for cigar smokers.

BACKGROUND OF THE INVENTION

Ever since smoking of cigars came into vogue a number of centuries ago, it has been found desirable to cut the end of the cigar which is inserted in the smoker's mouth for a brief distance axially in order to enable the smoker initially to draw air through the wrapped tobacco in order to light the opposite end, and thereafter, to draw the desired smoke axially through the cigar into the smoker's mouth.

In order to provide a suitable opening for this purpose, various instruments have been utilized to cut such an opening. These instruments have ranged from knives, including penknives, to sophisticated cutters that may cut off or even drill out a short axial opening. Drilling, however, can produce a ragged mouth-end for the cigar and, since one of the pleasures of cigar smoking is having a smooth cigar end inserted in the mouth, drilling and efforts to cut with a penknife have not been considered satisfactory.

Another type of cutter has been one that may have a cylindrical blade that slides out from a shield into the end of the cigar axially for a short distance to cut a plug that is removed upon withdrawal of the cylindrical cutter. The axial movement of the cutter, however, is usually accomplished through some type of thumb-actuated ram that operates against a spring, the purpose of which is to withdraw the cylindrical blade upon release of the thumb's force against the other end of the ram. While this type of cutter can be effective, at least initially, cutting becomes more difficult when the blade becomes duller, since the blade is simply forced axially against the tobacco packed inside the cigar wrapper. It has also been found that occasionally cutters driven by rams can damage the end of the cigar against which they are placed because of the force exerted by both the blade and its supporting element.

While other more sophisticated cutters have been devised, some of them have been quite complicated in construction and operation and quite expensive to manufacture, with the result that they may price themselves out of range of the average cigar smoker.

It has also been a concern of persons using certain of these cutters to avoid having the cutting blade scrape or dig into, the user's finger or thumb. Provision must be made, therefore, to shield a cutting blade to prevent possible injury either before, during, or after use of the cutter. In addition, recent airline regulations have severely restricted the transportation of many types of cutting devices aboard airplanes. As such, a cigar cutter that has a blade that does not extend outwardly above the top of its own cover is more likely to be approved for carrying on airlines.

U.S. Pat. No. 5,535,763 issued to Conte is directed to a cigar punch and tobacco ejector apparatus comprising a housing having a cylindrical hollow body attached to a base and having an open circular end, and a cutter having a barrel connected to a handle and a slot formed on the barrel adjacent to the handle. The housing is for storing the cutter when not in use. The cutter has a sharp, open-mouthed edge adapted to receive a tip of a cigar, to cut a piece from the cigar, to form a hole in the cigar's tip, and to hold the cut piece when the cigar is moved away from the cutter. A plunger assembly is connected to the cutter. The plunger assembly has a plunger adapted to travel within the cutter's barrel, a collar adapted to being placed over the barrel and to be connected to the plunger through the barrel's slot. A dowel pin is used to connect the collar to the plunger through the slot. The collar slides along the barrel as the dowel pin moves along the slot, thereby allowing the plunger to eject the cigar's cut piece from the cutter.

U.S. Pat. No. 4,160,318 issued to Morel, discloses an apparatus for severing predetermined lengths from a cigarette or cigar comprises a tubular passage that receives the cigarette or cigar to be cut, and a manually actuated blade positioned transverse to the longitudinal axis of the tubular passage and receivable there within for cutting the cigarette or cigar. The length of the cigarette or cigar receivable within the passage and severable by the blade may be varied by selectively positioning an adjustable end wall of the tubular passage.

U.S. Pat. No. 4,711,254, issued to Fleisher et al. describes a cigar holder that consists of a thin cylindrical-shaped tube that can be inserted within a mouth of a smoker. The tube has a hollow punch extending centrally inwardly to pierce butt end of a cigar for allowing free drawing of smoke. The thin cylindrical-shaped tube can be chewed on without harm to teeth of the smoker. The tube is provided with an adapter for holding variously sized cigars.

U.S. Pat. No. 4,027,682 issued to Halmaghi discloses a cigarette extinguishing and cigar cutting device mounted in the center of an ashtray which comprises a static base having a tapered top, a depressible stamper resiliently held above said base. Cigarettes may be snuffed out between the base and the depressed stamper. The cigar-cutting portion of the device is constituted by a horizontal hole cut through a section of the base intercepted by a vertical slot in which travels a blade fastened to the stamper.

While other variations exist, the above-described designs for cigar cutters are typical of those encountered in the prior art. It is an objective of the present invention to provide a cigar tip cutter that produces a neat round orifice in the cigar end without tearing or damaging the cigar wrapper. It is a further objective to provide such capability in a compact and attractive package that is simple to use. It is a still further objective of the invention to provide a cigar cutter that will protect its cutting blade from damage in the pocket of a user. It is yet a further objective to provide a cigar cutter that has a blade that does not extend beyond the limits of its enclosure.

While some of the objectives of the present invention are disclosed in the prior art, none of the inventions found include all of the requirements identified.

SUMMARY OF THE INVENTION

The present invention addresses all of the deficiencies of the prior art cigar tip cutting inventions and satisfies all of the objectives described above.

(2) A cigar tip plug cutter providing the desired features may be constructed from the following components. A cylindrical cutting blade is provided. The blade has an upper end, a lower end, a first internal diameter and a first external diameter. A support platform is provided. The support platform has an upper surface, a lower surface, a first central orifice and means for orthogonally mounting the cylindrical blade above the first central orifice. A cigar tip receiving plate is provided. The receiving plate has an upper surface, a lower surface, and a concave depression in the upper surface and a second central orifice in the concave depression. The second central orifice has a second diameter greater than the first external diameter.

A cigar plug ejector is provided. The ejector has a rod portion, a base portion and at least two support portions. The rod portion has an upper end, a lower end and a width less than the first internal diameter. The base portion has an upper surface, a lower surface and a first perimeter. The rod portion is attached at its lower end to a central portion of the upper surface of the base portion. Each of the support portions has an upper end, a lower end and is attached at its lower end to the upper surface of the base portion adjacent the first perimeter. The support platform has at least two openings penetrating its upper and lower surfaces and spaced from the first central orifice. The openings is sized, shaped and located to fit slidably about the support portions while permitting the rod portion to slide within the first central orifice and the first internal diameter of the cylindrical cutting blade. Each of the support portions is attached at its upper end to the lower surface of the cigar tip receiving plate while the support portions penetrate the support platform from its lower surface to its upper surface.

The cigar tip receiving plate is urged away from the support platform by at least two compression springs. A platform cover is provided. The platform cover has an upper surface and a lower surface and is sized and shaped to fit slidably over the cigar tip receiving plate. The platform cover has a third central orifice. The third central orifice is sized, shaped and located to accommodate the closed end of a cigar and permit access to the concave depression in the upper surface of the cigar tip receiving plate and the cylindrical blade. The platform cover is joined to the support platform.

When the closed end of a cigar is urged against the cigar tip receiving plate and the cylindrical blade and twisted about a central axis, the receiving plate will be displaced toward the support platform. The rod portion will be urged away from the platform cover while the cylindrical blade will cut through the cigar end, cutting a plug from it. When the cigar is removed and pressure applied to the lower surface of the base portion of the cigar plug ejector, the rod portion will serve to eject the plug from the cylindrical blade.

(3) In a variant of the invention, the cylindrical blade further comprises a retaining lip, the retaining lip is located about the first external diameter at the lower end of the blade.

(4) In another variant, the cylindrical blade includes a sharpened edge at the upper end, the sharpened edge comprising a bevel, the bevel extending downwardly toward the lower end from the first external diameter to the first internal diameter.

(5) In a further variant, the cylindrical blade is attached to the support platform with a retaining ring, the retaining ring has a fourth central orifice, the fourth central orifice is sized to fit slidably about the first external diameter. The retaining ring bears against the retaining lip of the cylindrical blade and is removably attached to the upper surface of the support platform.

(6) In still a further variant of the invention, the support platform further comprises at least two depressions in its upper surface, the depressions are sized and shaped to accept lower ends of the compression springs.

(7) In yet a further variant, the lower surface of the cigar tip receiving plate further comprises at least two depressions. The depressions are sized and shaped to accept upper ends of the compression springs.

(8) In another variant, at least one first detent is provided. The first detent is located on an outer surface of at least one of the support portions of the cigar plug ejector adjacent its upper end. At least one spring-loaded ball is provided. The spring-loaded ball is sized, shaped and located to bear against the outer surface and removably engage the first detent.

When the closed cigar end is urged against the cigar tip receiving plate and the cylindrical blade and twisted about a central axis, the receiving plate will be displaced toward the support platform, urging the support portions away from the platform cover. The spring-loaded ball will engage the first detent, thereby retaining the receiving plate and the rod portion in withdrawn positions, permitting withdrawal of the cigar end with the cut cigar plug retained within the cylindrical blade. When pressure is applied to the lower surface of the base portion of the cigar plug ejector, the spring-loaded ball will be dislodged from the first detent, permitting the compression springs to urge the cigar plug ejector toward the platform cover, thereby ejecting the cigar plug from the cylindrical blade.

(9) In still another variant of the invention, a second detent is provided. The second detent is located on an outer surface of at least one of the support portions of the cigar plug ejector adjacent its lower end. The second detent serves to retain the cigar plug ejector in an upper position adjacent the platform cover, thereby preventing unwanted exposure of the upper end of the cylindrical blade.

(10) In yet another variant, the spring-loaded ball is located in an axial bore in the platform cover adjacent the third central orifice.

(11) In still another variant, the cigar tip receiving plate is removably attached to first ends of the support portions of the cigar plug ejector with at least one setscrew.

(12) In a further variant of the invention, the'support portions further comprise a receiving notch, the receiving notch is sized, shaped and located to receive the setscrew.

(13) In yet a further variant, the support platform further comprises a recess in its lower surface, the recess is sized, shaped and located to accept the base portion of the cigar plug ejector, thereby permitting the support platform to have a smooth lower surface when the cigar plug ejector is in an upper position.

(14) In still a further variant, the platform cover is joined to the support platform by at least two pins, the pins fitting frictionally into aligned holes in mating surfaces of the platform cover and the support platform.

(15) In a final variant of the invention, the upper end of the cylindrical cutting blade is recessed below the upper surface of the platform cover.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (2) FIGS. 1–6 illustrate a cigar tip plug cutter 10 providing the desired features that may be constructed from the following components. As illustrated in FIGS. 2–5, a cylindrical cutting blade 15 is provided. The blade 15 has an upper end 20, a lower end 25, a first internal diameter 30 and a first external diameter 35. A support platform 40 is provided. The support platform 40 has an upper surface 45, a lower surface 50, a first central orifice 55 and means 60 for orthogonally mounting the cylindrical blade 15 above the first central orifice 55. A cigar tip receiving plate 65 is provided. The receiving plate 65 has an upper surface 70, a lower surface 75, a concave depression 80 in the upper surface 70 and a second central orifice 85 in the concave depression 80. The second central orifice 85 has a second diameter 90 greater than the first external diameter 35.

Figure 6:
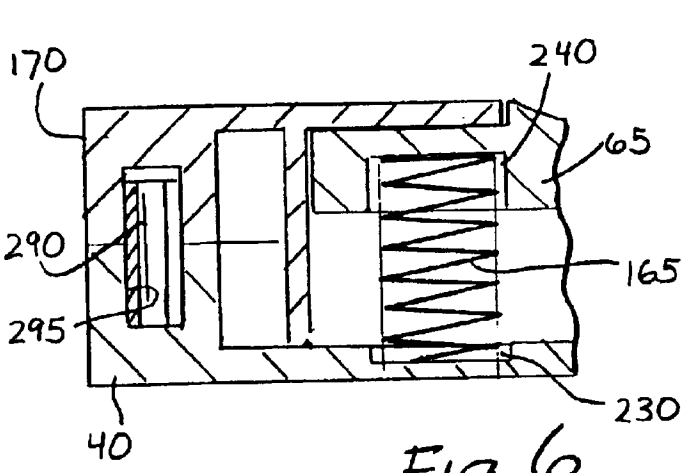
FIG. 6 is a partial cross-sectional view of the FIG. 1 embodiment taken along the line 6—6 illustrating one of the compression springs urging the cigar tip receiving plate away from the support platform.
Figure 1:
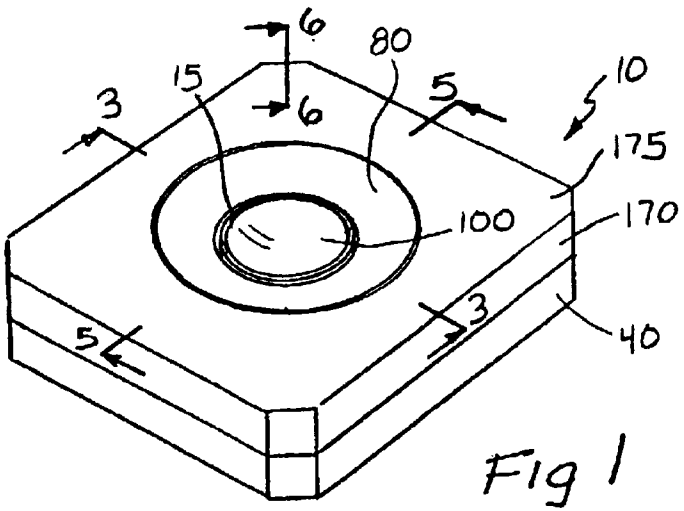
FIG. 1 is a perspective view of the preferred embodiment of the invention illustrating the cigar tip receiving plate with concave depression in the upper surface.

A cigar plug ejector 95 is provided. The ejector 95 has a rod portion 100, a base portion 105 and at least two support portions 110. The rod portion 100 has an upper end 115, a lower end 120 and a width 125 less than the first internal diameter 30. The base portion 105 has an upper surface 130, a lower surface 135 and a first perimeter 140. The rod portion 100 is attached at its lower end 120 to a central portion 145 of the upper surface 130 of the base portion 105. Each of the support portions 110 has an upper end 150, a lower end 155 and is attached at its lower end(s) to the upper surface 130 of the base portion 105 adjacent the first perimeter 140. The support platform 40 has at least two openings 160 penetrating its upper 45 and lower 50 surfaces and spaced from the first central orifice 55. The openings 160 are sized, shaped and located to fit slidably about the support portions 110 while permitting the rod portion 100 to slide within the first central orifice 55 and the first internal diameter 30 of the cylindrical cutting blade 15. Each of the support portions 110 is attached at its upper end 150 to the lower surface 75 of the cigar tip receiving plate 65 while the support portions 110 penetrate the support platform 40 from its lower surface 50 to its upper surface 45.

The cigar tip receiving plate 65 is urged away from the support platform 40 by at least two compression springs 165. A platform cover 170 is provided. The platform cover 170 has an upper surface 175 and a lower surface 180 and is sized and shaped to fit slidably over the cigar tip receiving plate 65. The platform cover 170 has a third central orifice 185. The third central orifice 185 is sized, shaped and located to accommodate a closed end 190 of a cigar 195 and permit access to the concave depression 80 in the upper surface 70 of the cigar tip receiving plate 65 and the cylindrical blade 15. The platform cover 170 is joined to the support platform 40.

Figure 1A:
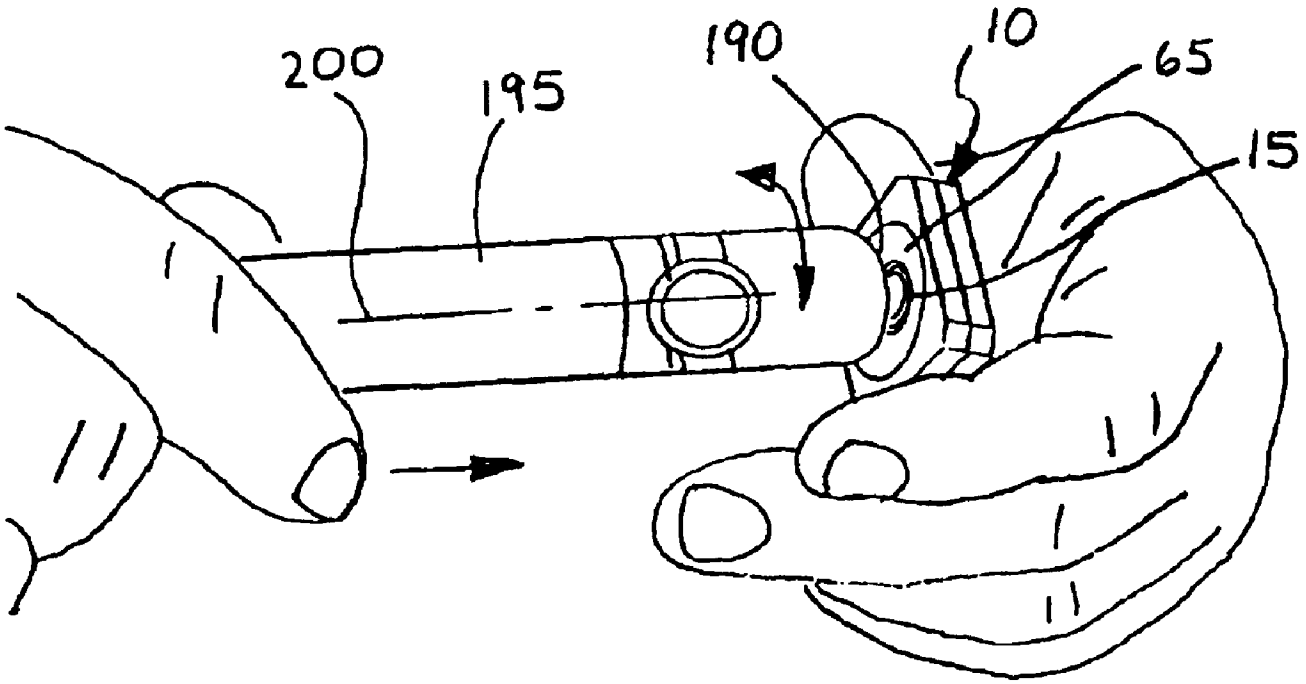
FIG. 1A is perspective view of the FIG. 1 embodiment being used to cut a plug from the tip of a cigar.
Figure 2:
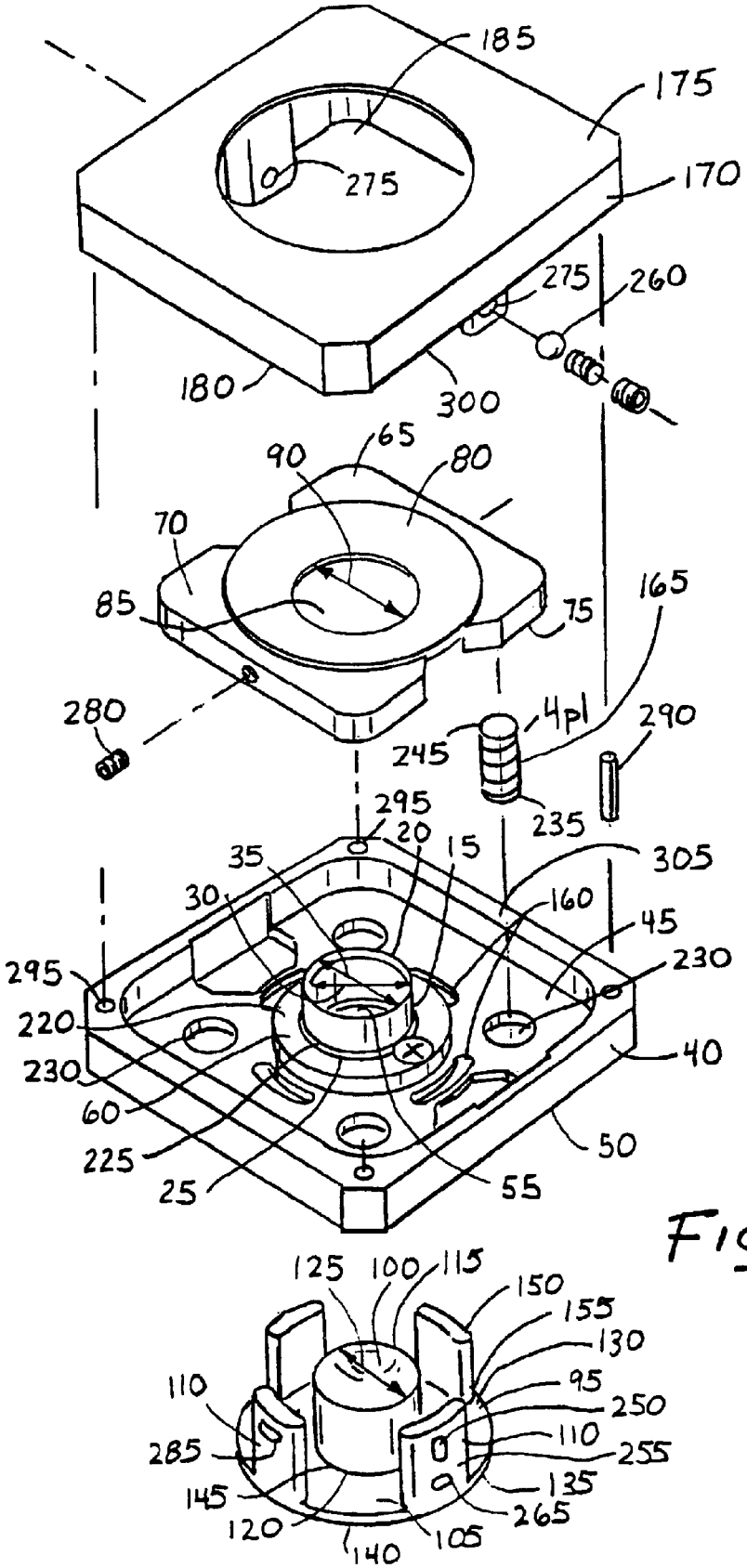
FIG. 2 is an exploded perspective view of the FIG. 1 embodiment illustrating internal details of the design.

As illustrated in FIGS. 1A and 2, when the closed end 190 of a cigar 195 is urged against the cigar tip receiving plate 65 and the cylindrical blade 15 and twisted about a central axis 200, the receiving plate 65 will be displaced toward the support platform 40. The rod portion 100 will be urged away from the platform cover 170 while the cylindrical blade 15 will cut through the cigar end 190, cutting a plug (not shown) from it. When the cigar 195 is removed and pressure applied to the lower surface 135 of the base portion 105 of the cigar plug ejector 95, the rod portion 100 will serve to eject the plug from the cylindrical blade 15.

Figure 5:
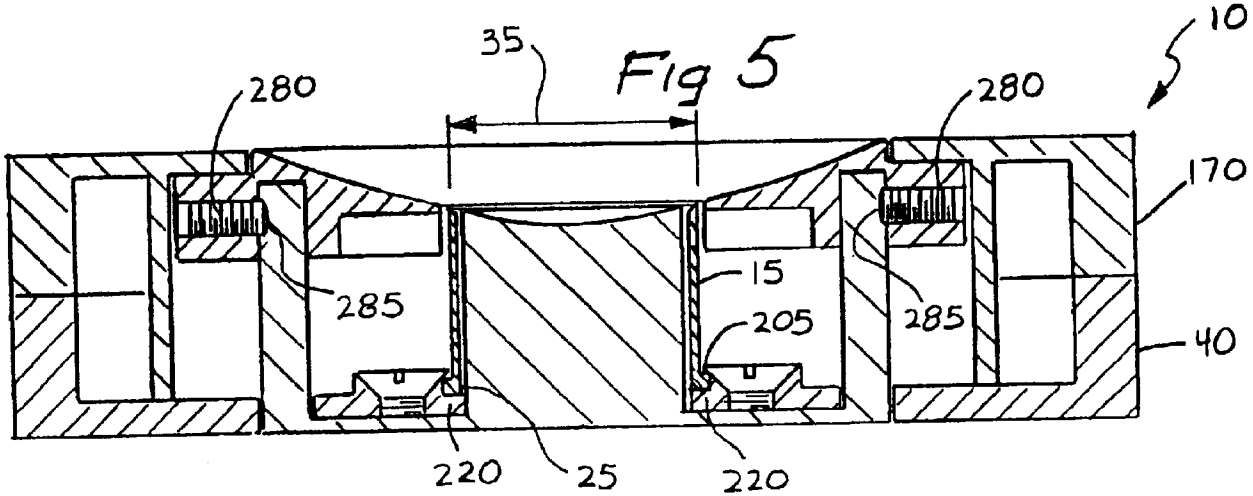
FIG. 5 is a cross-sectional view of the FIG. 1 embodiment taken along the line 5—5 illustrating the setscrews attaching the cigar tip receiving plate to the cigar plug ejector.
Figure 3:
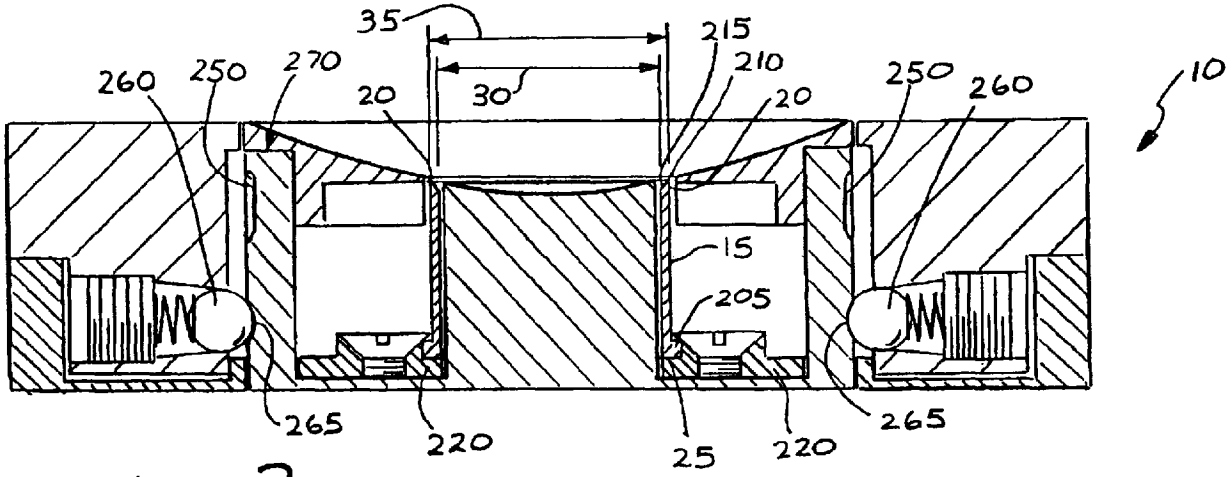
FIG. 3 is a cross-sectional view of the FIG. 1 embodiment taken along the line 3—3 illustrating the cigar tip receiving plate in an upper position.
Figure 4:
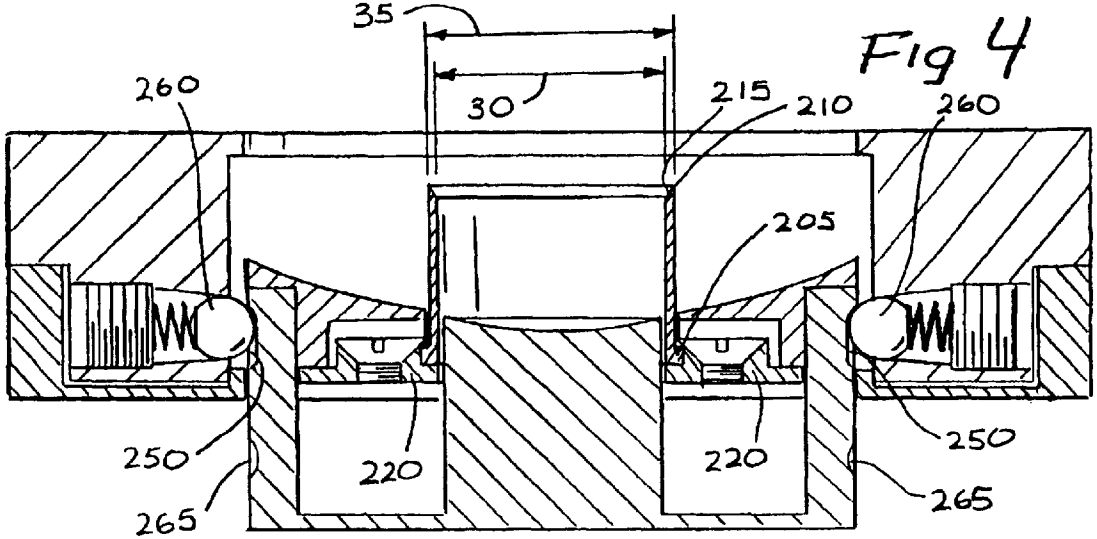
FIG. 4 is a cross-sectional view of the FIG. 1 embodiment taken along the line 3—3 illustrating the cigar tip receiving plate in a lowered position.

(3) In a variant of the invention, as illustrated in FIG. 3–5, the cylindrical blade 15 further comprises a retaining lip 205, the retaining lip 205 is located about the first external diameter 35 at the lower end 25 of the blade 15.

(4) In another variant, as illustrated in FIGS. 3–5, the cylindrical blade 15 includes a sharpened edge 210 at the upper end 20, the sharpened edge 210 comprising a bevel 215, the bevel 215 extending downwardly toward the lower end 25 from the first external diameter 35 to the first internal diameter 30.

(5) In a further variant, as illustrated in FIG. 2–5, the cylindrical blade 15 is attached to the support platform 40 with a retaining ring 220, the retaining ring 220 has a fourth central orifice 225, the fourth central orifice 225 is sized to fit slidably about the first external diameter 35. The retaining ring 220 bears against the retaining lip 205 of the cylindrical blade 15 and is removably attached to the upper surface 45 of the support platform 40.

(6) In still a further variant of the invention, as illustrated in FIG. 2, the support platform 40 further comprises at least two depressions 230 in its upper surface 45, the depressions 230 are sized and shaped to accept lower ends 235 of the compression springs 165.

(7) In yet a further variant, as illustrated in FIG. 6, the lower surface 75 of the cigar tip receiving plate 65 further comprises at least two depressions 240. The depressions 240 are sized and shaped to accept upper ends 245 of the compression springs 165.

(8) In another variant, as illustrated in FIGS. 2–5, at least one first detent 250 is provided. The first detent 250 is located on an outer surface 255 of at least one of the support portions 110 of the cigar plug ejector 95 adjacent its upper end 150. At least one spring-loaded ball 260 is provided. The spring-loaded ball 260 is sized, shaped and located to bear against the outer surface 255 and removably engage the first detent 250.

When the closed cigar end 190 is urged against the cigar tip receiving plate 65 and the cylindrical blade 15 and twisted about a central axis 200, the receiving plate 65 will be displaced toward the support platform 40, urging the support portions 110 away from the platform cover 170. The spring-loaded ball 260 will engage the first detent 250, thereby retaining the receiving plate 65 and the rod portion 100 in withdrawn positions, permitting withdrawal of the cigar end 190 with the cut cigar plug retained within the cylindrical blade 15. When pressure is applied to the lower surface 135 of the base portion 105 of the cigar plug ejector 95, the spring-loaded ball 260 will be dislodged from the first detent 250, permitting the compression springs 165 to urge the cigar plug ejector 95 toward the platform cover 170, thereby ejecting the cigar plug from the cylindrical blade 15.

(9) In still another variant of the invention, as illustrated in FIGS. 2–5, a second detent 265 is provided: The second detent 265 is located on an outer surface 255 of at least one of the support portions 110 of the cigar plug ejector 95 adjacent its lower end 155. The second detent 265 serves to retain the cigar plug ejector 95 in an upper position 270 adjacent the platform cover 170, thereby preventing unwanted exposure of the upper end 20 of the cylindrical blade 15.

(10) In yet another variant, as illustrated in FIG. 2, the spring-loaded ball 260 is located in an axial bore 275 in the platform cover 170 adjacent the third central orifice 185.

(11) In still another variant, as illustrated in FIG. 2, the cigar tip receiving plate 65 is removably attached to upper ends of the support portions 110 of the cigar plug ejector 95 with at least one setscrew 280.

(12) In a further variant of the invention, as illustrated in FIGS. 2 and 5, the support portions 110 further comprise a receiving notch 285, the receiving notch 285 is sized, shaped and located to receive the setscrew 280.

(13) In yet a further variant, the support platform 40 further comprises a recess (not shown) in its lower surface 50, the recess is sized, shaped and located to accept the base portion 105 of the cigar plug ejector 95, thereby permitting the support platform 40 to have a smooth lower surface 50 when the cigar plug ejector 95 is in an upper position 270.

(14) In still a further variant, as illustrated in FIG. 2, the platform cover 170 is joined to the support platform 40 by at least two pins 290, the pins 290 fitting frictionally into aligned holes 295 in mating surfaces 300, 305 of the platform cover 170 and the support platform 40.

(15) In a final variant of the invention, as illustrated in FIGS. 3–5, the upper end 20 of the cylindrical cutting blade 15 is recessed below the upper surface 175 of the platform cover 170.

The cigar tip plug cutter 10 has been described with reference to particular embodiments. Other modifications and enhancements can be made without departing from the spirit and scope of the claims that follow.

What is claimed is:

1. A cigar tip plug cutter, comprising:

a support platform, said support platform having a first central orifice and at least two openings spaced from said first central orifice;

a cylindrical cutting blade, said blade orthogonally mounted to said support platform above said first central orifice;

a cigar tip receiving plate, said receiving plate having an upper surface, a lower surface, a concave depression in said upper surface and a second central orifice in said concave depression, said second central orifice being sized shaped and disposed to slidably accept said cutting blade;

a cigar plug ejector, said ejector having a rod portion, a base portion and at least two support portions, each of said support portions having an upper end and a lower end and being sized, shaped and disposed to fit slidably through said at least two openings in said support platform;

said base portion having an upper surface, a lower surface, central portion and a first perimeter;

said rod portion having an upper end and a lower end and being sized shaped and disposed to fit slidably through said cylindrical blade and being attached at its lower end to said central portion of the upper surface of said base portion;

said support portions being attached at their lower ends adjacent said first perimeter of said base portion and attached at their upper end to said lower surface of said cigar tip receiving plate while fitted through said at least two openings in said support platform;

said rod portion extending through said first central orifice in said support platform and through said cylindrical cutting blade;

said cigar tip receiving plate being urged away from said support platform by at least two compression springs;

a platform cover, said platform cover being sized and shaped to fit slidably over said cigar tip receiving plate and having a third central orifice sized, shaped and disposed to accommodate the closed end of a cigar and permit access to said concave depression in the upper surface of said cigar tip receiving plate and said cylindrical blade;

said platform cover being joined to said support platform; and whereby, when the closed end of a cigar is urged against said cigar tip receiving plate and said cylindrical blade and twisted about a central axis, said receiving plate will be displaced toward said support platform and said rod portion will be urged away from said platform cover while said cylindrical blade will cut through said cigar end, cutting a plug therefrom, and when said cigar is removed and pressure applied to said lower surface of said base portion of said cigar plug ejector, said rod portion will serve to eject said plug from said cylindrical blade.

2. A cigar tip plug cutter, comprising:

a cylindrical cutting blade, said blade having an upper end, a lower end, a first internal diameter and a first external diameter;

a support platform, said support platform having an upper surface, a lower surface, a first central orifice and means for orthogonally mounting said cylindrical blade above said first central orifice;

a cigar tip receiving plate, said receiving plate having an upper surface, a lower surface, a concave depression in said upper surface and a second central orifice in said concave depression, said second central orifice having a second diameter greater than said first external diameter;

a cigar plug ejector, said ejector having a rod portion, a base portion and at least two support portions;

said rod portion having an upper end, a lower end and a width less than said first internal diameter;

said base portion having an upper surface, a lower surface and a first perimeter;

said rod portion being attached at its lower end to a central portion of the upper surface of said base portion;

each of said support portions having an upper end, a lower end and being attached at its lower end to the upper surface of said base portion adjacent said first perimeter;

said support platform having at least two openings penetrating its upper and lower surfaces and spaced from said first central orifice, said openings being sized, shaped and disposed to fit slidably about said support portions while permitting said rod portion to slide within said first central orifice and the first internal diameter of said cylindrical cutting blade;

each of said support portions being attached at its upper end to the lower surface of said cigar tip receiving plate while said support portions penetrate said support platform from its lower surface to its upper surface;

said cigar tip receiving plate being urged away from said support platform by at least two compression springs;

a platform cover, said platform cover having an upper surface and a lower surface and being sized and shaped to fit slidably over said cigar tip receiving plate and having a third central orifice sized, shaped and disposed to accommodate the closed end of a cigar and permit access to said concave depression in the upper surface of said cigar tip receiving plate and said cylindrical blade;

said platform cover being joined to said support platform; and whereby, when the closed end of a cigar is urged against said cigar tip receiving plate and said cylindrical blade and twisted about a central axis, said receiving plate will be displaced toward said support platform and said rod portion will be urged away from said platform cover while said cylindrical blade will cut through said cigar end, cutting a plug therefrom, and when said cigar is removed and pressure applied to said lower surface of said base portion of said cigar plug ejector, said rod portion will serve to eject said plug from said cylindrical blade.

3. A cigar tip plug cutter as described in claim 2, wherein said cylindrical blade further comprises a retaining lip, said retaining lip disposed about the first external diameter at the lower end of said blade.

4. A cigar tip plug cutter as described in claim 2, wherein said cylindrical blade further comprises a sharpened edge at said upper end, said sharpened edge comprising a bevel, said bevel extending downwardly toward said lower end from said first external diameter to said first internal diameter.

5. A cigar tip plug cutter as described in claim 3, wherein said cylindrical blade is attached to said support platform with a retaining ring, said retaining ring having a fourth central orifice, said fourth central orifice being sized to fit slidably about said first external diameter, said retaining ring bearing against said retaining lip of said cylindrical blade and being removably attached to the upper surface of said support platform.

6. A cigar tip plug cutter as described in claim 2, wherein said support platform further comprises at least two depressions in its upper surface, said depressions being sized and shaped to accept lower ends of said compression springs.

7. A cigar tip plug cutter as described in claim 2, wherein the lower surface of said cigar tip receiving plate further comprises at least two depressions said depressions being sized and shaped to accept upper ends of said compression springs.

8. A cigar tip plug cutter as described in claim 2, further comprising:

at least one first detent, said first detent being disposed upon an outer surface of at least one of said support portions of said cigar plug ejector adjacent its upper end;

at least one spring-loaded ball, said spring loaded ball being sized, shaped and disposed to bear against said outer surface and removably engage said first detent; and whereby, when said closed cigar end is urged against said cigar tip receiving plate and said cylindrical blade and twisted about a central axis, said receiving plate will be displaced toward said support platform, urging said support portions away from said platform cover, said spring loaded ball will engage said first detent, thereby retaining said receiving plate and said rod portion in withdrawn positions, permitting withdrawal of said cigar end with the cut cigar plug retained within said cylindrical blade, and when pressure is applied to the lower surface of the base portion of the cigar plug ejector, the spring-loaded ball will be dislodged from the first detent, permitting the compression springs to urge the cigar plug ejector toward the platform cover, thereby ejecting the cigar plug from the cylindrical blade.

9. A cigar tip plug cutter as described in claim 8, further comprising:

a second detent, said second detent being disposed upon an outer surface of at least one of said support portions of said cigar plug ejector adjacent its lower end; and said second detent serving to retain said cigar plug ejector in an upper position adjacent the platform cover, thereby preventing unwanted exposure of the upper end of the cylindrical blade.

10. A cigar tip plug cutter as described in claim 8, wherein said spring-loaded ball is disposed in an axial bore in said platform cover adjacent said third central orifice.

11. A cigar tip plug cutter as described in claim 2, wherein said cigar tip receiving plate is removably attached to first ends of said support portions of said cigar plug ejector with at least one setscrew.

12. A cigar tip plug cutter as described in claim 11, wherein said support portions further comprise a receiving notch, said receiving notch being sized, shaped and disposed to receive said setscrew.

13. A cigar tip plug cutter as described in claim 2, wherein said support platform further comprises a recess in its lower surface, said recess being sized, shaped and disposed to accept said base portion of said cigar plug ejector, thereby permitting said support platform to have a smooth lower surface when said cigar plug ejector is in an upper position.

14. A cigar tip plug cutter as described in claim 2, wherein said platform cover is joined to said support platform by at least two pins, said pins fitting frictionally into aligned holes in mating surfaces of said platform cover and said support platform.

15. A cigar tip plug cutter as described in claim 2, wherein the upper end of said cylindrical cutting blade is recessed below the upper surface of said platform cover.

* * * * *